US009542781B2

(12) United States Patent
Hatton

(10) Patent No.: US 9,542,781 B2
(45) Date of Patent: Jan. 10, 2017

(54) VEHICLE SYSTEM COMMUNICATING WITH A WEARABLE DEVICE TO PROVIDE HAPTIC FEEDBACK FOR DRIVER NOTIFICATIONS

(71) Applicant: Ford Global Technologies, LLC, Dearborn, MI (US)

(72) Inventor: David Anthony Hatton, Berkley, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/713,545

(22) Filed: May 15, 2015

(65) Prior Publication Data

US 2016/0335817 A1 Nov. 17, 2016

(51) Int. Cl.

| | |
|---|---|
| ***G08B 21/00*** | (2006.01) |
| ***G07C 5/08*** | (2006.01) |
| ***G07C 5/00*** | (2006.01) |

(52) U.S. Cl.

CPC ..... *G07C 5/0816* (2013.01); *G07C 5/008* (2013.01)

(58) Field of Classification Search

CPC ..... G07C 5/0816
USPC ..... 340/435, 438, 407.1, 407.2
See application file for complete search history.

(56) References Cited

U.S. PATENT DOCUMENTS 8,036,715 B2 10/2011 Buck et al.
2015/0246639 A1* 9/2015 Nagata ..... B60Q 9/008 340/435

* cited by examiner

*Primary Examiner* — Jeffery Hofsass
(74) *Attorney, Agent, or Firm* — Jennifer M. Stec; Brooks Kushman P.C.

(57) ABSTRACT

A system includes a user interface and a controller in communication with a transceiver and the user interface. The controller is configured to receive a predefined threshold and alert for a vehicle indication at the user interface. The controller is further configured to generate a notification based on the preconfigured alert in response to the vehicle indication exceeding the predefined threshold. The controller is further configured to transmit, via the transceiver, the notification for the vehicle indication to a wearable device configured to output the predefined alert.

15 Claims, 6 Drawing Sheets

VEHICLE SYSTEM COMMUNICATING WITH A WEARABLE DEVICE TO PROVIDE HAPTIC FEEDBACK FOR DRIVER NOTIFICATIONS

TECHNICAL FIELD

The present disclosure generally relates to vehicle systems, and more particularly, to systems and methods using applications on wearable devices in communication with vehicle systems.

BACKGROUND

A mobile device having a computing system has prompted application developers to bring additional features and functions to the user's mobile device. These features and functions have included fitness, music, and navigation applications. The mobile device may be configured to include wireless communication technology to enable the device to communicate with other computing systems. An example of the mobile device includes portable computers such as a smartwatch, a smartphone, an activity tracker (e.g., wristband devices), and/or a combination thereof.

SUMMARY

In at least one embodiment, a system includes a user interface and a controller in communication with a transceiver and the user interface. The controller is configured to receive a predefined threshold and alert for a vehicle indication at the user interface. The controller is further configured to generate a notification based on the preconfigured alert in response to the vehicle indication exceeding the predefined threshold. The controller is further configured to transmit, via the transceiver, the notification for the vehicle indication to a wearable device configured to output the predefined alert.

In at least one embodiment, a vehicle computing system includes at least one processor in communication with a transceiver to communicate vehicle data to a wearable device. The at least one processor is configured to transmit a haptic alert to a wearable device communicating with the transceiver based on one or more vehicle indications exceeding a predefined threshold. The one or more vehicle indications are monitored by one or more vehicle sensors and are associated with a predefined number of vibrations for the haptic alert. The one or more vehicle indications are based on at least one of an accelerator pedal input, a radio volume input, navigation information, and lane departure detection.

In at least one embodiment, a method to communicate vehicle indication data to a wearable device includes monitoring a parameter associated with a vehicle indication configured for output at a display using a sensor in communication with a control module. The method further includes generating a notification based on a preconfigured alert based on the parameter exceeding a predefined threshold. The method transmits the notification for the indication to a wearable device configured to output the notification based on the predefined alert using a transceiver in communication with the vehicle control module.

DETAILED DESCRIPTION

Figure 1:
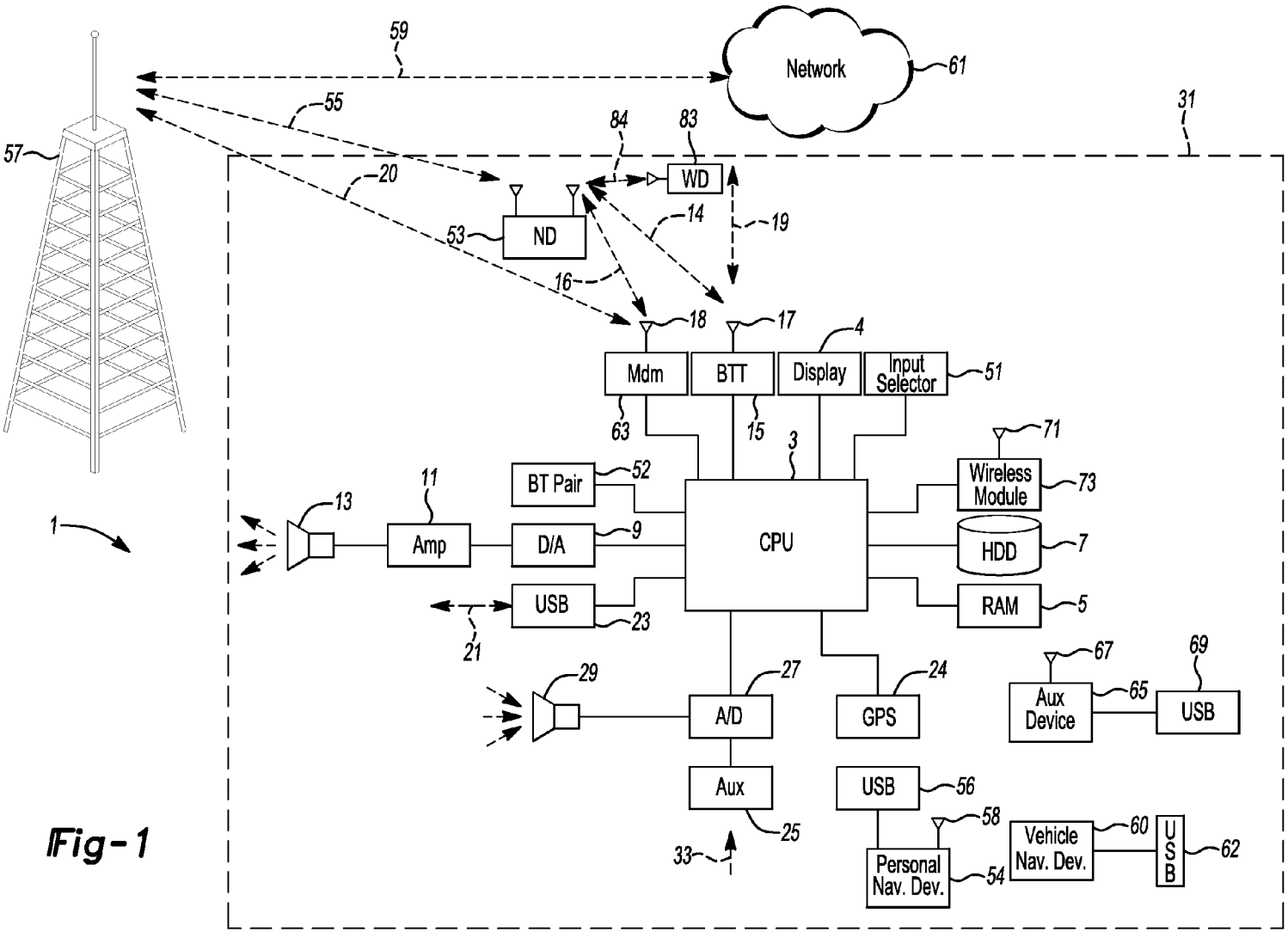
FIG. 1 is a representative block topology of a vehicle infotainment system implementing a user-interactive vehicle information display system according to an embodiment.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The embodiments of the present disclosure generally provide for a plurality of circuits or other electrical devices. All references to the circuits and other electrical devices and the functionality provided by each, are not intended to be limited to encompassing only what is illustrated and described herein. While particular labels may be assigned to the various circuits or other electrical devices disclosed, such labels are not intended to limit the scope of operation for the circuits and the other electrical devices. Such circuits and other electrical devices may be combined with each other and/or separated in any manner based on the particular type of electrical implementation that is desired. It is recognized that any circuit or other electrical device disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any one or more of the electric devices may be configured to execute a computer-program that is embodied in a non-transitory computer readable medium that is programmed to perform any number of the functions as disclosed.

A vehicle computing system may provide a number of indications to a vehicle occupant that includes a seat belt reminder, an open door indicator, a tire pressure warning light, an engine management light, etc. During vehicle operation, the occupant may receive the indications via an instrument panel, a speaker, user interface display and/or a combination thereof. The occupant may receive the indication based on information from a vast range of sensors and on-board equipment in communication with the vehicle computing system. The information provides an overview of what the vehicle computing system has detected and how the occupant should act.

The vehicle computing system may output the number of indications to a mobile device via a communication connection. The vehicle computing system may be configured to communicate with the mobile device using wireless technology. In addition to communicating with the mobile device, the vehicle computing system may communicate with an accessory device being worn by a vehicle operator. The accessory device may establish communication with the vehicle computing system via the communication connection. In another example, the accessory device may communicate with the vehicle computing system using the mobile device as a connection bridge with the vehicle computing system.

The accessory device, herein referred to as a wearable device, may be configured to communicate via a short-range wireless broadcast enabling communication with other devices in proximity to the broadcast. The wearable device may wirelessly receive, command, and/or display data to/from a system having the ability to communicate with the short-range wireless broadcast. For example, the wearable device may be configured to receive indications from the vehicle computing system. The wearable device may comprise one or more software applications executed on a processor, a transceiver, and other hardware at the device to carry out one or more notifications based on the indications from the vehicle computing system. For example, if the vehicle computing system detects that the operator is exceeding a predefined speed and/or speed limit, the wearable device may vibrate a predefined number of times based on the received speed detection message form the vehicle computing system. The wearable device may comprise various input methods including touch and/or a physical button, and may include a unique graphical interface and/or light emitting diode (LED) indicator. The wearable device may communicate with the vehicle computing system using wireless communication.

The methods and systems for the wearable device to communicate vehicle information received from the vehicle computing system while reducing the number of indications outputted at the instrument panel, the speaker, the user interface display, and/or a combination thereof are described in greater detail herein. The vehicle computing system includes one or more applications executed on hardware of the system to configure the wearable device to communicate vehicle information (e.g., vehicle information indications) based on communication with the vehicle computing system. In another embodiment, the mobile device may include one or more applications executed on hardware of the device to configure the wearable device to communicate vehicle indications based on data received from the vehicle computing system. The vehicle computing system may communicate with the wearable device based on one or more wireless technologies. The vehicle computing system may transmit vehicle indication data to the wearable device using wireless technology.

FIG. 1 illustrates an example block topology for a vehicle based computing system 1 (VCS) for a vehicle 31. An example of such a vehicle-based computing system 1 is the SYNC system manufactured by THE FORD MOTOR COMPANY. A vehicle enabled with a vehicle-based computing system may contain a visual front end interface 4 located in the vehicle. In another example, the VCS may contain the visual front end interface 4, an instrument panel, and/or a combination thereof. The user may also be able to interact with the interface if it is provided, for example, with a touch sensitive screen. In another illustrative embodiment, the interaction occurs through button presses and/or spoken dialog with automatic speech recognition and speech synthesis.

In the illustrative embodiment 1 shown in FIG. 1, a processor 3 controls at least some portion of the operation of the vehicle-based computing system. Provided within the vehicle, the processor allows onboard processing of commands and routines. Further, the processor is connected to both non-persistent 5 and persistent storage 7. In this illustrative embodiment, the non-persistent storage is random access memory (RAM) and the persistent storage is a hard disk drive (HDD) or flash memory. In general, persistent (non-transitory) memory can include all forms of memory that maintain data when a computer or other device is powered down. These include, but are not limited to, HDDs, CDs, DVDs, magnetic tapes, solid state drives, portable USB drives and any other suitable form of persistent memory.

The processor is also provided with a number of different inputs allowing the user to interface with the processor. In this illustrative embodiment, a microphone 29, an auxiliary input 25 (for input 33), a USB input 23, a GPS input 24, screen 4, which may be a touchscreen display, and a BLUETOOTH input 15 are all provided. An input selector 51 is also provided, to allow a user to choose various inputs. Input to both the microphone and the auxiliary connector is converted from analog to digital by a converter 27 before being passed to the processor. Although not shown, numerous vehicle components and auxiliary components in communication with the VCS may use a vehicle network (such as, but not limited to, a CAN bus) to pass data to and from the VCS (or components thereof).

Outputs to the system can include, but are not limited to, the user-interface visual display 4, the instrument panel (e.g., instrument cluster) and a speaker 13 or stereo system output. The speaker is connected to an amplifier 11 and receives its signal from the processor 3 through a digital-to-analog converter 9. Output can also be made to a remote BLUETOOTH device such as PND 54 or a USB device such as vehicle navigation device 60 along the bi-directional data streams shown at 19 and 21 respectively.

In one illustrative embodiment, the system 1 uses the BLUETOOTH transceiver 15 to communicate 17 with a user's nomadic device 53 (e.g., cell phone, smart phone, PDA, or any other device having wireless remote network connectivity). The nomadic device can then be used to communicate 59 with a network 61 outside the vehicle 31 through, for example, communication 55 with a cellular tower 57. In some embodiments, tower 57 may be a WiFi access point. The nomadic device 53 may also be used to communicate 84 with an accessory device 83 such as a wearable device 83 (e.g., smartwatch, smart glasses, etc.). The nomadic device 53 may communicate 84 one or more control functions to the wearable device 83. For example, the nomadic device 53 may enable the wearable device 83 to accept a phone call, enable a mobile application, receive vehicle notifications and indications, and/or a combination thereof. In another example, the wearable device 83 may receive vehicle information from the vehicle computing system 1 based on one or more mobile applications executed at the nomadic device 53. Communication between the nomadic device and the BLUETOOTH transceiver is generally represented by signal 14.

In another illustrative embodiment, the VCS 1 may use the BLUETOOTH transceiver 15 to communicate with the wearable device 83. The wearable device 83 may receive vehicle indication information from the VCS 1. For example, the number of indications displayed at the instrument panel may be transmitted to the wearable device based on a configuration of one or more applications being executed at the VCS 1, wearable device 83, nomadic device 53, and/or a combination thereof. In one example, the operator may configure one or more indications to be transmitted to the wearable device at the user interface display 4. In another example, the operator may configure one or more indications to be transmitted to the wearable device 83 at the nomadic device user interface. The indication configuration for the wearable device 83 may include, but is not limited to, the selection of which vehicle indication information is transmitted to the wearable device 83. The configuration may also include the actions the wearable device 83 may perform based on the selected vehicle indication information.

For example, the VCS 1 may be in communication with a lane departure warning (LDW) system. The LDW system may monitor if the vehicle begins to move out of its lane unless a turn signal is on in that direction. The VCS 1 may be configured to transmit a haptic warning message to the wearable device 83 if the LDW system detects the vehicle moving out of its lane. The haptic warning message may be configured to vibrate a predefined number of times based on the LDW system detections.

In another example, the nomadic device 53 may be configured to transmit a haptic warning message to the wearable device 83 based on LDW signals received from the VCS 1. The nomadic device 53 may execute an application comprising an API to receive vehicle data via the VCS 1. The nomadic device 53 may allow a user to configure the application to transmit one or more haptic messages to the wearable device based on the received vehicle data via the VCS 1.

Pairing a nomadic device 53 and the BLUETOOTH transceiver 15 can be instructed through a button 52 or similar input. Accordingly, the CPU is instructed that the onboard BLUETOOTH transceiver will be paired with a BLUETOOTH transceiver in a nomadic device. The wearable device 83 may be paired to communicate with the nomadic device 53. The wearable device 83 may receive messages from the CPU 3 via the nomadic device 53 in communication with the VCS 1. In another embodiment, the wearable device 83 and the BLUETOOTH transceiver 15 may be paired in a process similar to the nomadic device 53 pairing process.

Data may be communicated between CPU 3 and network 61 utilizing, for example, a data-plan, data over voice, or DTMF tones associated with nomadic device 53. Alternatively, it may be desirable to include an onboard modem 63 having antenna 18 to communicate 16 data between CPU 3 and network 61 over the voice band. The nomadic device 53 may then be used to communicate 59 with a network 61 outside the vehicle 31 through, for example, communication 55 with a cellular tower 57. In some embodiments, the modem 63 may establish communication 20 with the tower 57 for communicating with network 61. As a non-limiting example, modem 63 may be a USB cellular modem and communication 20 may be cellular communication.

In one illustrative embodiment, the processor is provided with an operating system including an API to communicate with modem application software. The modem application software may access an embedded module or firmware on the BLUETOOTH transceiver to complete wireless communication with a remote BLUETOOTH transceiver (such as that found in a nomadic device and wearable device). Bluetooth is a subset of the IEEE 802 PAN (personal area network) protocols. IEEE 802 LAN (local area network) protocols include WiFi and have considerable cross-functionality with IEEE 802 PAN. Both are suitable for wireless communication within a vehicle. Another communication means that can be used in this realm is free-space optical communication (such as IrDA) and non-standardized consumer IR protocols.

In another embodiment, nomadic device 53 includes a modem for voice band or broadband data communication. In the data-over-voice embodiment, a technique known as frequency division multiplexing may be implemented when the owner of the nomadic device may talk over the device while data is being transferred. At other times, when the owner is not using the device, the data transfer can use the whole bandwidth (300 Hz to 3.4 kHz in one example). While frequency division multiplexing may be common for analog cellular communication between the vehicle and the internet, and is still used, it has been largely replaced by hybrids of Code Domain Multiple Access (CDMA), Time Domain Multiple Access (TDMA), Space-Domain Multiple Access (SDMA) for digital cellular communication. These are all ITU IMT-2000 (3G) compliant standards and offer data rates up to 2 mbs for stationary or walking users and 385 kbs for users in a moving vehicle. 3G standards are now being replaced by IMT-Advanced (4G) which offers 100 mbs for users in a vehicle and 1 gbs for stationary users. If the user has a data-plan associated with the nomadic device, it is possible that the data-plan allows for broad-band transmission and the system could use a much wider bandwidth (speeding up data transfer). In still another embodiment, nomadic device 53 is replaced with a cellular communication device (not shown) that is installed to vehicle 31. In yet another embodiment, the ND 53 may be a wireless local area network (LAN) device capable of communication over, for example (and without limitation), an 802.11g network (i.e., WiFi) or a WiMax network.

In one embodiment, incoming data can be passed through the nomadic device via a data-over-voice or data-plan, through the onboard BLUETOOTH transceiver and into the vehicle's internal processor 3. In the case of certain temporary data, for example, the data can be stored on the HDD or other storage media 7 until such time as the data is no longer needed.

Additional sources that may interface with the vehicle include a personal navigation device 54, having, for example, a USB connection 56 and/or an antenna 58, a vehicle navigation device 60 having a USB 62 or other connection, an onboard GPS device 24, or remote navigation system (not shown) having connectivity to network 61. USB is one of a class of serial networking protocols. IEEE 1394 (FireWire™ (Apple), i.LINK™ (Sony), and Lynx™ (Texas Instruments)), EIA (Electronics Industry Association) serial protocols, IEEE 1284 (Centronics Port), S/PDIF (Sony/Philips Digital Interconnect Format) and USB-IF (USB Implementers Forum) form the backbone of the device-device serial standards. Most of the protocols can be implemented for either electrical or optical communication.

Further, the CPU 3 may be in communication with a variety of other auxiliary devices 65. These devices can be connected through a wireless 67 or wired 69 connection. Auxiliary devices 65 may include, but are not limited to, personal media players, wireless health devices, portable computers, and the like.

Also, or alternatively, the CPU 3 may be connected to a vehicle based wireless router 73, using for example a WiFi (IEEE 803.11) 71 transceiver. This could allow the CPU to connect to remote networks in range of the local router 73.

In addition to having various processes executed by a vehicle computing system located in a vehicle, in certain embodiments, processes may be executed by a computing system in communication with a vehicle computing system. Such a system may include, but is not limited to, a wireless device (e.g., and without limitation, a mobile phone) or a remote computing system (e.g., and without limitation, a server) connected through the wireless device. Collectively, such systems may be referred to as vehicle associated computing systems (VACS). In certain embodiments particular components of the VACS may perform particular portions of a process depending on the particular implementation of the system. By way of example and not limitation, if a process includes sending or receiving information with a paired wireless device, then it is likely that the wireless device is not performing the process, since the wireless device would not "send and receive" information with itself. One of ordinary skill in the art will understand when it is inappropriate to apply a particular VACS to a given solution. In all solutions, it is contemplated that at least the vehicle computing system (VCS) located within the vehicle itself is capable of performing the representative processes.

Figure 2:
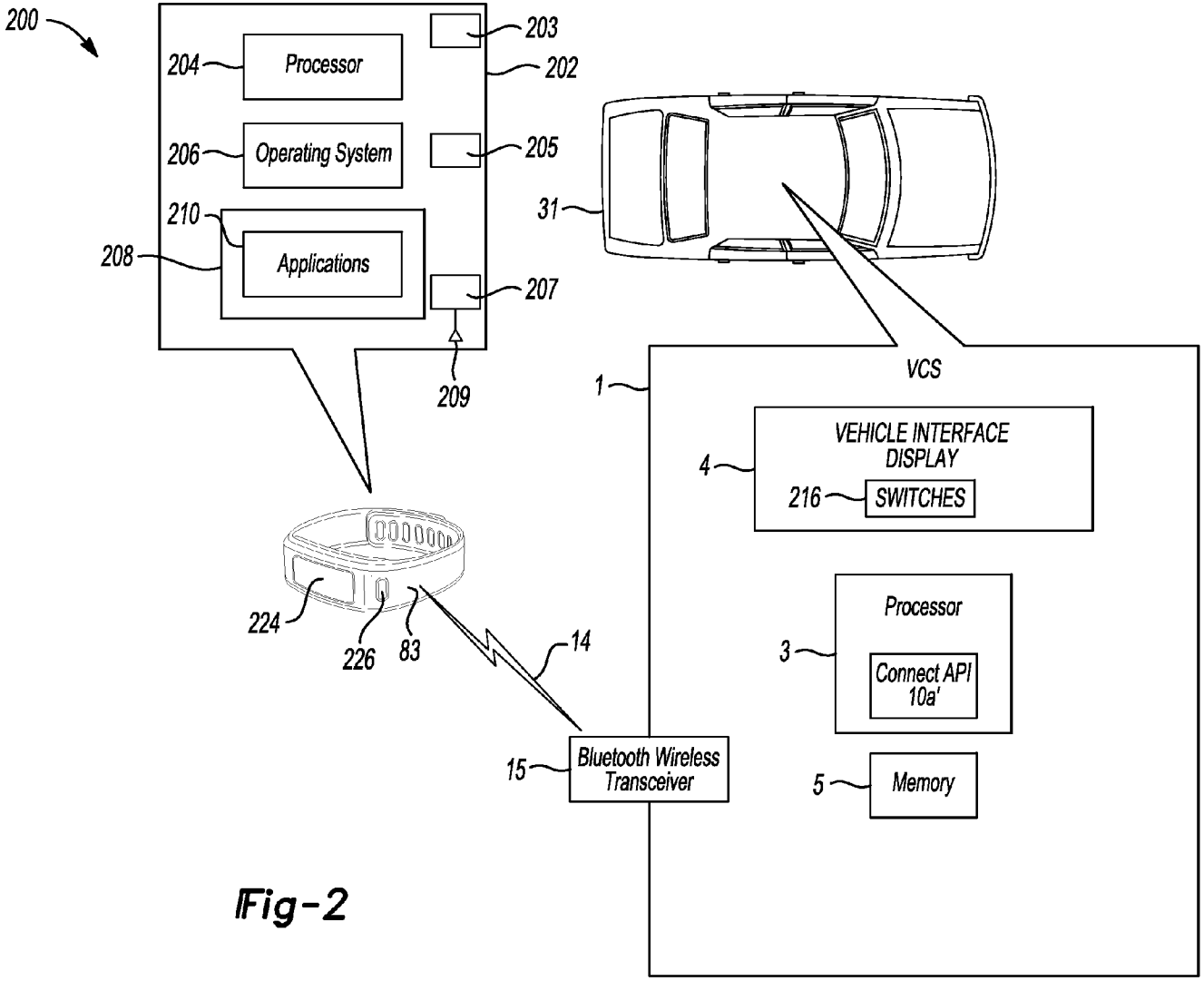
FIG. 2 is a representative block topology of a system for integrating a wearable device with the vehicle based computing system according to an embodiment.

FIG. 2 is a representative block topology of a system 200 for integrating the wearable device 83 with the VCS 1 according to an embodiment. The wearable device 83 may include a system 202 comprising at least one processor 204, a vibrating motor 205, an operating system 206, a transceiver 209 for wireless communication 207, and memory 208 to store one or more applications 210. The wearable device 83 may execute the one or more applications 210 with hardware of the system 202. The wearable device 83 may also include user interface hardware including a display 224, one or more motion detectors 203, and/or an input mechanism 226.

The wearable device 83 may transmit one or more messages to the vehicle 31 via the wireless transceiver 209. The one or more messages may be based on movement detection via the one or more motion detectors 203 and/or input via the input mechanism 226 of the wearable device 83. The VCS 1 may configure one or more vehicle indication alerts to transmit to the wearable device 83 based on the input and/or movement detection at the wearable device 83.

For example, a speed limitation indication may be configured to alert the vehicle operator of a vehicle speed exceeding a predefined speed limit using the wearable device 83. The VCS 1 may be configured to transmit the speed limitation indication to the wearable device 83 via a wireless connection 14 with the BLUETOOTH wireless transceiver 15 at the vehicle 31. The VCS 1 may be configured to select one or more wearable devices 83 to receive the speed limitation indication using the user interface display 4. The VCS 1 configuration may include, but is not limited to, the number of haptic notifications and/or number of vibrations to be set based on the speed limitation indication. In one example, if the vehicle speeds exceeds the predefined speed limit, the VCS 1 may transmit an alert to vibrate the wearable device in a two pulse vibration pattern. In another example, the VCS 1 may be configured to transmit an alert to continuously vibrate the wearable device until the vehicle speed is below the predefined speed limit.

The VCS 1 may provide haptic feedback to the vehicle operator via the wearable device 83. For example, a volume limitation indication for the infotainment system may be configured to alert the vehicle operator of a volume level exceeding a predefined threshold. The VCS 1 may be configured to transmit a haptic feedback alert to the wearable device 83 once the volume level is reached. In one example, the vehicle operator may adjust the volume while driving the vehicle. In another example, the VCS 1 may monitor the increase in volume of the infotainment system and as the volume approaches the predefined threshold, the system transmits an increased persistent haptic feedback alert to the wearable device.

The VCS 1 and the wearable device 83 may undergo a series of communications back and forth to each other (e.g., handshaking) for communication authentication purposes. The VCS 1 may transmit vehicle indication data to the wearable device 83 based on a successful completion of the handshaking process. For example, if the VCS 1 does not recognize the wearable device 83, the vehicle interface display 4 may prompt the user to pair the wearable device 83. The vehicle interface display 4 may transmit a command signal to search for the wireless device via BLUETOOTH to determine whether the wearable device 83 has been previously paired. In another example, the VCS 1 may communicate with the wearable device via a nomadic device connection.

The vehicle interface display 4 may be implemented as a message center on an instrument cluster or as a touch screen monitor such that each wearable device is generally configured to receive text, alerts, status, haptic feedback or other such messages for an occupant based on the configuration. The occupant may scroll through the various fields of text/options and select one or more vehicle indications via at least one control switch 216. The control switch 216 may be remotely positioned from the interface display or positioned directly on the interface display. The control switch 216 may include, but is not limited to, a hard button, soft button, touchscreen, voice command, and/or other such external devices (e.g., phones, computers, etc.) that are generally configured to communicate with the VCS 1 of the vehicle 31.

The vehicle interface display 4 may be any such device that is generally situated to provide information and receive feedback to/from a vehicle occupant. The interface display 4, the processor 3, and the other components in communication with the VCS 1 may communicate with each other via a multiplexed data link communication bus (e.g., CAN Bus).

For example, the VCS 1 may include at least one processor 3 that may comprise body electronic controls of an interior section of the vehicle 31. The at least one processor 3 may include a plurality of fuses, relays, and various micro-controllers for performing any number of functions related to the operation of interior and/or exterior electrically based vehicle functionality. Such functions may include, but are not limited to, electronic unlocking/locking status via interior door lock/unlock switches, seat belt engaged/disengaged detection, door ajar detection, vehicle lighting (e.g., interior and/or exterior), and/or electronic power windows. The VCS 1 may have one or more indications each representing one of the number of functions related to the operation of the vehicle.

The control switch 216 may include one or more switches. The one or more switches may include an ignition switch (not shown) that may be operably coupled to the one or more processors 3. The ignition switch may transmit multiplexed messages on the vehicle network that are indicative of whether the ignition switch position is Off, On, Start, or Accessory.

The VCS 1 may initialize and/or enable hardware components of the system based on the ignition switch. The VCS 1 may be configured to establish communication 14 (e.g., Bluetooth Low Energy, Near Field Communication, etc.) with the wearable device 83 once the ignition is being requested On. For example, once the wearable device 83 connects with the VCS 1 via the wireless connection 14, the VCS 1 may transmit one or more vehicle indications to the wearable device 83.

In one example, the communication 14 between the VCS 1 and wearable device 83 may be generated by the wireless transceiver 15. The wireless broadcast signal 14 may notify the wearable device 83 of the presence of the VCS 1. For example, the wireless transceiver 15 may include, but is not limited to, an iBeacon broadcast. The wireless transceiver generating the iBeacon signal may include, but is not limited to, a low-powered wireless transceiver 15. The iBeacon broadcast generated by the wireless transceiver 15 may send a push notification to the wearable device (i.e., wireless devices) in close proximity of the VCS 1.

The iBeacon may use Bluetooth Low Energy (BLE) proximity sensing to transmit a universally unique identifier (UUID). The UUID is an identifier standard that may be used to uniquely identify the application on the wearable device 83 associated with the VCS 1.

For example, the wearable device 83 may include an application having a UUID (e.g., a sixty-four hexadecimal character identifier). The VCS 1 may receive a wakeup indicator to begin the iBeacon broadcast comprising the UUID. The iBeacon broadcast may be transmitted to the one or more wearable devices 83 in proximity of the vehicle 31. The iBeacon broadcast may include the UUID associated with the application stored at the wearable device 83. Once the application is launched, the wearable device 83 may transmit data to the VCS 1 to notify the VCS 1 that the communication is established. For example, a vehicle identification application at the wearable device 83 may transmit a message notifying the VCS 1 that the application may be configured to enable a haptic and/or vibration alert if the unlocked door and/or the door ajar is detected during vehicle operation (e.g., the vehicle is traveling at a speed greater than zero miles per hour). The wearable device 83 may transmit and receive data to/from the VCS 1 via the established communication 14.

The wearable device 83 may transmit one or more configuration functions based on at least one of movement of the device, specific input to the device such as a touch to the input mechanism 226 and/or a combination thereof. The VCS 1 may transmit a message via the wireless signal 14 to the wearable device 83 if authorization to communicate corresponds to a recognized device based on at least one of a manufacturer code, a corresponding communication pairing code, and/or an encrypted code.

The wearable device 83 may include the transceiver 209 for communicating with the vehicle 31. The wearable device 83 processor 204 comprises one or more integrated circuits. The processor 204 in communication with the transceiver 209 is adapted to transmit the corresponding communication pairing code in the form of a wireless communication signal 14 to the VCS 1 via the Bluetooth wireless transceiver 15. The communication pairing code may generally comprise data that corresponds to the manufacturer code, the corresponding communication pairing code, and/or an encrypted code at the VCS 1.

The VCS 1 may transmit a vehicle indication message based on the at least one controller 3 decoding the corresponding communication pairing code received from the wearable device 83. The VCS 1 compares the code to an approved wireless communication device (e.g., paired wireless device) look up table to determine whether such code matches prior to transmitting the vehicle indication messages.

For example, the wearable device 83 may receive a message from the VCS 1 that the doors are unlocked. Until the vehicle occupant wearing the wearable device 83 performs the maneuver to lock the doors, the VCS 1 may transmit the message to the wearable device 83 at predefined time intervals as a reminder.

The VCS 1 may determine a driver status based on monitored data from the one or more motion detectors 203 at the wearable device 83. For example, the wearable device 83 may monitor whether the driver is performing a driving maneuver (e.g., turning the steering wheel). The VCS 1 may delay the vehicle indication message transmitted to the wearable device 83 until after the driving maneuver has been completed.

The VCS 1 may enable one or more predefined functional limitations of the vehicle system if a secondary driver (e.g. alternate or different driver from a previously detected driver) is detected based on a second wearable device 83. The one or more predefined function limitations that are related to vehicle indications may include, but are not limited to, vehicle travel notification, volume control of the infotainment system, and/or speed limiting calibrations. For example, predefined indications related to a seat belt reminder, fuel level indicator, reverse parking (e.g., transmission gear selection), object detection, and/or traction control may be transmitted to the second wearable device 83 based on a configuration for the secondary driver. In one example, the VCS 1 may enable one or more predefined settings of infotainment controls based on a recognized wearable device 83 including, but not limited to, radio presets, seat settings, and/or climate control settings for the second driver.

In another example, the VCS 1 may have an embedded cellular modem (not shown) such that the wearable device 83 may be detected by the system using WiFi communication. In this example, the VCS 1 may also transmit the iBeacon to the wearable device 83 to enable communication via one or more applications at the device. Once the application is enabled, the system may begin to exchange security data between the VCS 1 and wearable device 83. The wearable device 83 may begin receiving one or more vehicle indications using the WiFi communication.

Figure 3A:
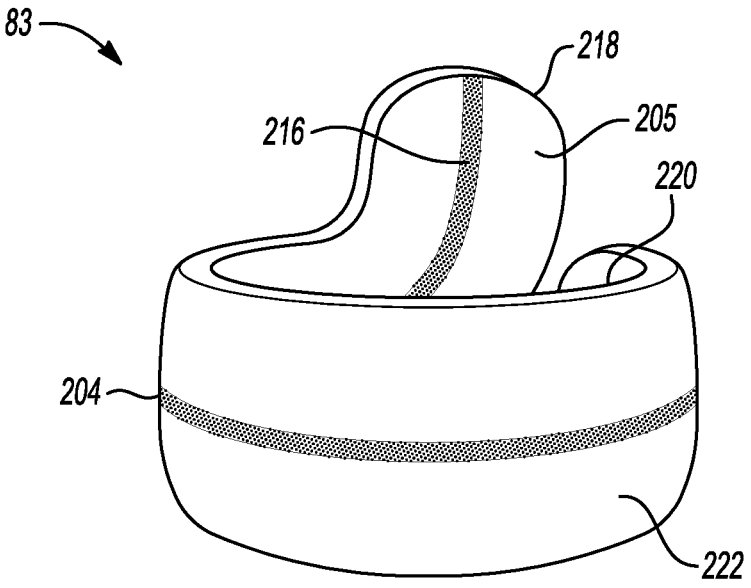
FIGS. 3A-3B illustrate a representative embodiment of the wearable device configured to communicate with the vehicle based computing system.
Figure 3B:
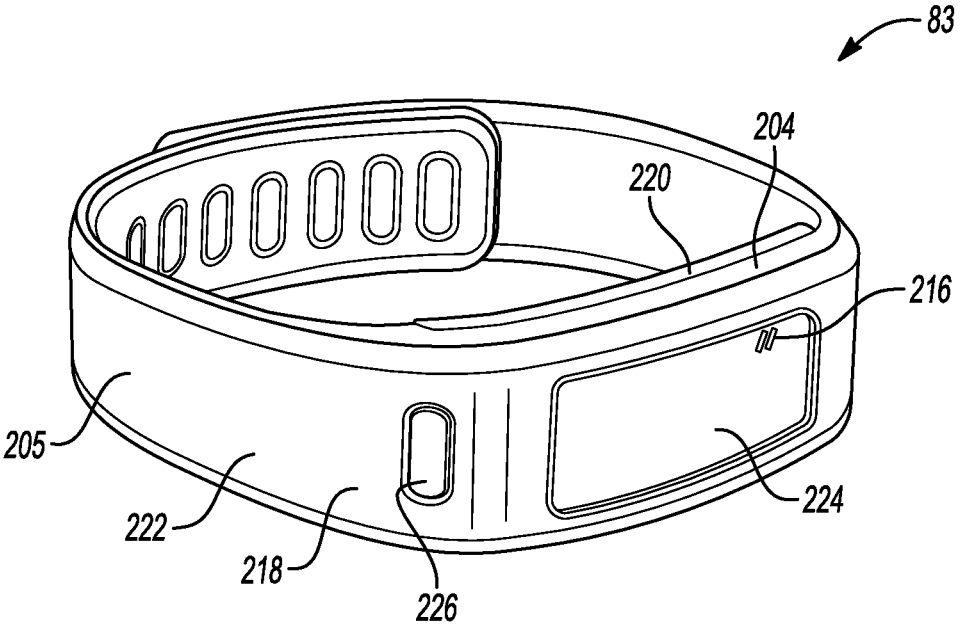

FIGS. 3A-3B illustrate a representative embodiment of the wearable device 83 configured to communicate with the VCS 1. FIG. 3A illustrates a representative embodiment of the wearable device 83 configured as a ring 83. The ring 83 configuration may include, but is not limited to, a system 202 integrated within the ring having a processor 204, a vibrating motor 205, an LED indicator 216, a sensor 218, a battery 220, and/or a wireless transceiver 222 (e.g., Bluetooth). The ring wearable device 83 may allow the user to receive haptic feedback and/or vibration pulses based on the movement of the device when adjusting one or more functions related to the operation of the vehicle functionality. For example, the VCS 1 may detect that the vehicle operator is adjusting the climate control of the vehicle 31 based on the monitored movement of the ring via the sensor 218. The VCS 1 may provide haptic feedback via the ring wearable device 83 based on the climate control reaching a preconfigured desired temperature setting.

FIG. 3B illustrates a representative embodiment of the wearable device 83 configured as a bracelet. The bracelet 83 configuration may include, but is not limited to, a system 202 having a processor 204, a vibrating motor 205, an LED indicator 216, a sensor 218, a battery 220, a wireless transceiver 222, a display 224, and/or a switch 226. The bracelet wearable device 83 may allow the user to receive vehicle indications based on the display 224, the vibrating motor, and a combination thereof. For example, the VCS 1 may transmit a wireless signal to the bracelet wearable device 83 notifying the device that a vehicle indication is present. The display 224 of the bracelet may output a message to the vehicle operator based on the vehicle indication. For example, if the vehicle indication is a low fuel warning, the bracelet wearable device 83 may receive the low fuel warning indication and output a low fuel message reminder via the display 224. The low fuel message may be stored at the wearable device 83 for a predetermined amount of time before a reminder message of low fuel is transmitted to the display. In another example, the bracelet wearable device 83 may be configured to, in response to the low fuel message being active, provide a low fuel reminder message to the vehicle operator after ignition OFF is detected. The reminder feature may provide the vehicle operator notice to allow time for stopping to get fuel before a subsequent next trip.

Figure 4:
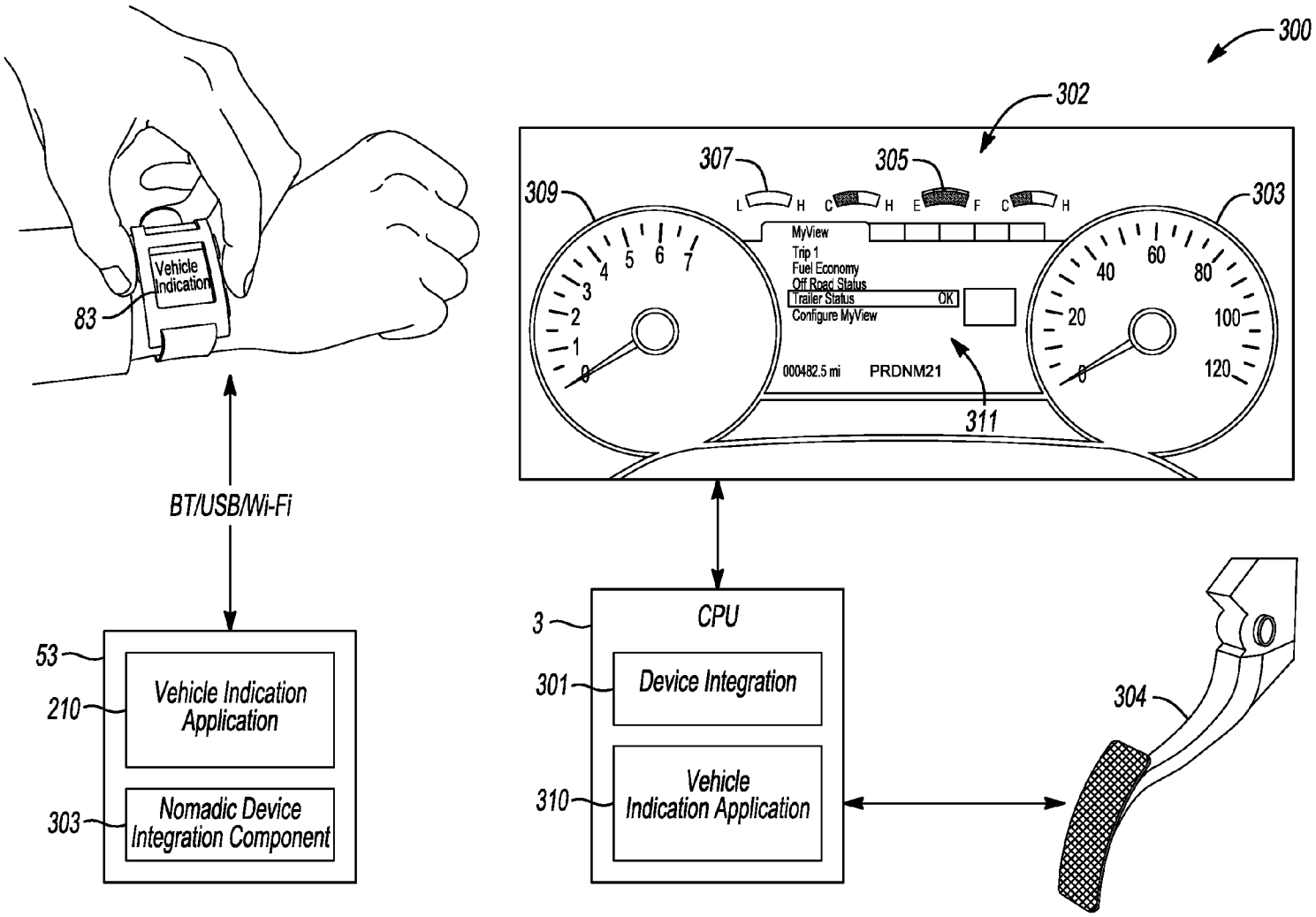
FIG. 4 is a representative block topology of a system for integrating the wearable device with the vehicle based computing system according to an embodiment.

FIG. 4 is an illustrative block topology of a system 300 for integrating the wearable device 83 with the VCS 1 according to an embodiment. The CPU 3 may be in communication with one or more transceivers. The one or more transceivers are capable of wired and wireless communication for the integration of one or more devices. To facilitate the integration, the CPU 3 may include a device integration framework 301 configured to provide various services to the connected devices. These services may include transport routing of messages between the connected devices and the CPU 3, global notification services to allow connected devices to provide alerts to the user, application launch and management facilities to allow for unified access to applications executed by the CPU 3 and those executed by the connected devices, accident detection notification (i.e., 911 ASSIST™), vehicle access control (e.g., locking and unlocking the vehicle doors), and the vehicle indication application configured to transmit vehicle systems and parameter indications with the use of the wearable device 83.

As previously described, the CPU 3 of the VCS 1 may be configured to interface with one or more nomadic devices 53 of various types. The nomadic device 53 may further include a device integration client component 303 to allow the nomadic device 53 (e.g., smartphone) to take advantage of the services provided by the CPU 3 device integration framework 301. The device integration client component 303 may be referred to as an application. The application is executed on hardware at the nomadic device 53. The application may communicate data from the nomadic device 53 to the VCS 1 via the transceiver. In one example, the application may be configured to generate vehicle indication messages based on data received from the CPU 3.

The nomadic device 53 may communicate application data with the wearable device 83 via wireless technology. As shown in FIG. 4, the wearable device 83 may include a smartwatch. The wireless technology may include Bluetooth, Bluetooth Low Energy (BLE), WiFi, etc. The wearable device 83 may receive application data executed at the nomadic device 53 using a wearable device integration component (e.g., applications 210). The wearable device integration component may allow the wearable device 83 to take advantage of the services provided by the device integration framework 301 and the device integration client component 303. For example, the wearable device 83 may receive vehicle indication data including one or more vehicle indication parameters for the vehicle. The wearable device 83 may receive one or more vehicle indications from the VCS 1 via the nomadic device 53. In one example, the wearable device 83 may receive a vehicle speed alert when a vehicle speed received from the CPU 3 exceeds a preconfigured speed threshold set at the nomadic device.

The instrument panel 302 may output one or more vehicle indications based on received data from the CPU 3. As shown in FIG. 4, the instrument panel 302 illustrates one or more vehicle indications including, but not limited to, vehicle speed 303, low tire pressure, navigation information, fuel level 305, oil pressure 307, revolutions per minute (RPMs) 309, and a message display 311. The VCS 1 may be configured to enable the at least one processor (e.g., CPU 3) to configure one or more vehicle indications to be transmitted to the wearable device 83. The at least one processor may execute the vehicle indication application configured to monitor one or more vehicle systems and sensors using preconfigured threshold values.

In one example, a user may set a preconfigured threshold value to monitor engine RPMs to improve fuel economy via the vehicle identification application 310. The preconfigured threshold may be configured to notify the vehicle operator that driving behavior is too aggressive, therefore fuel economy performance is reduced. For example, the preconfigured threshold may be set to approximately 4500 RPMs. The CPU 3 may generate an alert if the RPMs exceed and/or reach 4500 RPMs to notify the vehicle operator of aggressive driving. The notification to improve fuel economy based on the RPM preconfigured threshold may be presented at the message display 311 of the instrument panel 302. The CPU 3 may be configured to transmit an alert based on the RPM preconfigured threshold to the wearable device 83 via the device integration 301, the nomadic device integration component 303, and/or a combination thereof. The vehicle identification application 310 and/or the nomadic device integration component 303 may configure the alert to generate a vibration pulse at the wearable device 83. For example, the wearable device 83 may provide a haptic feedback to the vehicle operator for improving fuel economy based on the RPM preconfigured threshold monitored by the CPU 3. The nomadic device 53 may receive the alert from the CPU 3 based on the nomadic device integration component 303 and the vehicle indication application 210. The nomadic device 53 may transmit the alert to the wearable device 83 via the wireless communication. In another example, the CPU 3 may be configured to reduce the number of vehicle indications presented at the instrument panel 303 based on an established communication with the wearable device 83.

The vehicle identification application 310 executed at the CPU 3 may monitor the position of an accelerator pedal 304 to improve fuel economy. For example, a preconfigured threshold may be set to a value indicating driving acceleration is too aggressive, therefore fuel economy performance is degraded. For example, the accelerator pedal 304 may have a range of motion from zero to one hundred percent to command acceleration of a powertrain of the vehicle 31. The preconfigured threshold may be set to approximately sixty percent position of the accelerator pedal 304 as a threshold indicating, when exceeded, that the vehicle operator may be too aggressive while driving. The CPU 3 may generate an alert if the position of the accelerator pedal 304 reaches or exceeds the sixty percent position. In response to the alert, the CPU 3 may notify the vehicle operator of aggressive driving via a haptic warning using the wearable device 83. For example, once the CPU 3 detects that the accelerator pedal 304 exceeds the preconfigured threshold value of sixty percent position, the wearable device 83 outputs a haptic feedback to the vehicle operator.

In another example, CPU 3 may receive navigation information from a navigation system. The CPU 3 may transmit the navigation information to the wearable device. The navigation information may be configured to notify a user of a right turn and a left turn. For example, if a right turn is detected for the next intersection, the VCS 1 may be configured to send one vibration to the wearable device 83. If a left turn is detected for the next intersection, the VCS may be configured to send two vibrations to the wearable device 83.

Figure 5:
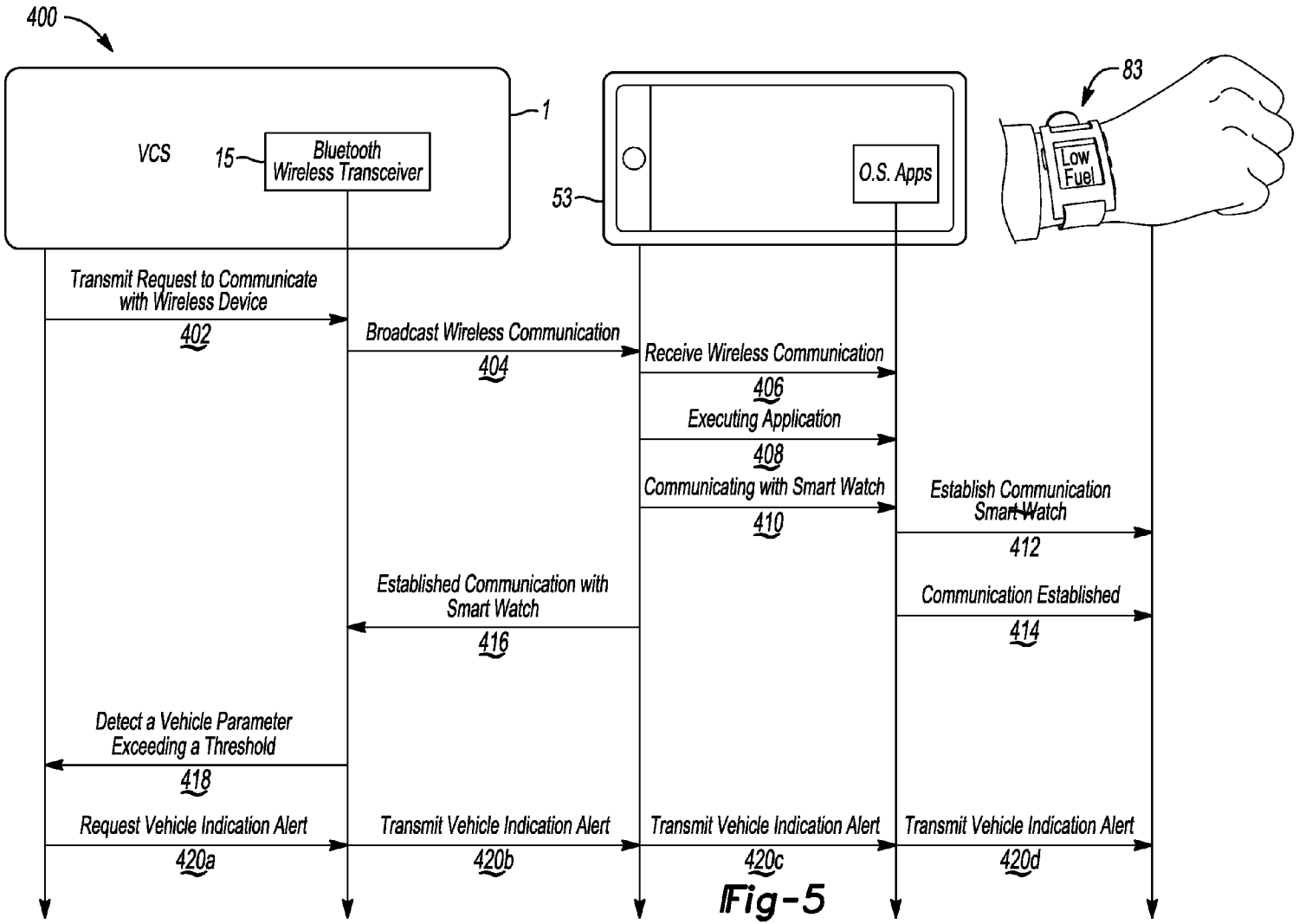
FIG. 5 is a flow chart illustrating an example method of the vehicle computing system communicating one or more vehicle indications to the wearable device via a nomadic device according to an embodiment.

FIG. 5 is a flow chart illustrating an example method 400 of the VCS 1 communicating one or more vehicle indications to the wearable device 83 via the nomadic device 53 according to an embodiment. The VCS 1 may establish wireless connection with the smartwatch 83 via the nomadic device 53. The VCS 1 may communicate with one or more applications on the smartwatch 83 based on the established wireless connection with the nomadic device 53. The VCS 1 may comprise one or more applications executed on hardware of the system to transmit the vehicle indication message to the smart watch device 83 via the nomadic device 53.

The VCS 1 may transmit a request to communicate 402 with a wireless device based on a detection signal, a broadcast signal and/or a combination thereof via the Bluetooth transceiver 15. The Bluetooth wireless transceiver 15 may broadcast a wireless protocol 404 to send notifications to the nomadic device 53. The broadcast may comprise a unique wireless identification predefined by an original equipment manufacturer, a control module, and/or a combination thereof.

The nomadic device 53 may receive 406 the broadcast signal to begin establishing communication with the VCS 1. The nomadic device 53 operating system software may execute 408 the one or more mobile applications (e.g., vehicle indication application) compatible with the VCS 1. In one example, the nomadic device 53 may find the vehicle indication application that is associated with the VCS 1. The vehicle indication application may be launched at the nomadic device 53.

The nomadic device 53 may communicate 410 with the smartwatch application based on the vehicle indication application executed at the nomadic device 53. The nomadic device 53 may transmit one or more instructions to configure the user interface of the smartwatch 83 based on the vehicle indication application. The smartwatch 83 user interface may include, but is not limited to, a touch screen display, soft buttons, hard buttons, and/or a combination thereof.

The nomadic device 53 may establish a communication link 412 via the wireless protocol using the mobile application's Bluetooth service. The nomadic device may establish a communication 414 with the smartwatch. The vehicle indication application being launched at the nomadic device 53 may communicate application data to the VCS 1. The application data may include, but is not limited to, a status bit informing the VCS 1 that the application is running. The Bluetooth wireless transceiver 15 may communicate the application data to the one or more processors at the VCS 1 for execution.

The nomadic device 53 may transmit an established smartwatch communication message 416 to the VCS 1. The VCS 1 may monitor one or more preconfigured threshold values based on parameters via vehicle systems and sensor data. The VCS 1 may detect 418 a vehicle parameter exceeding a preconfigured threshold value. The VCS 1 may request 420*a* a vehicle indication alert based on the vehicle parameter exceeding the preconfigured threshold. The Bluetooth wireless transceiver 15 may transmit 420*b* the vehicle indication alert to the nomadic device 53. The nomadic device may transmit 420*c* the vehicle indication alert to the vehicle indication application executed at the operating system of the device 53. The vehicle indication application may transmit 420*d* the vehicle indication alert to the smartwatch 83.

The smartwatch application may include a vehicle indication application for the vehicle. In response to a vehicle indication, the one or more functions of the vehicle indication application may include, but are not limited to, haptic feedback, preconfigured vibration pulses related to a vehicle indication, a reminder message for display after vehicle operation, and/or a combination thereof. In one example, the smartwatch 83 may configure the user interface to output a reminder that the fuel level is low. The reminder may be stored at the nomadic device and/or smartwatch. The smartwatch may output the reminder after a predetermined amount of time has elapsed after a key-off event is detected. The reminder may allow the vehicle operator to allocate enough time to stop for gas when planning the next trip in the vehicle. In another embodiment, the smartwatch 83 reminder may include a battery charge level such that the vehicle operator may be reminded to plug-in the charger for a hybrid vehicle.

Figure 6:
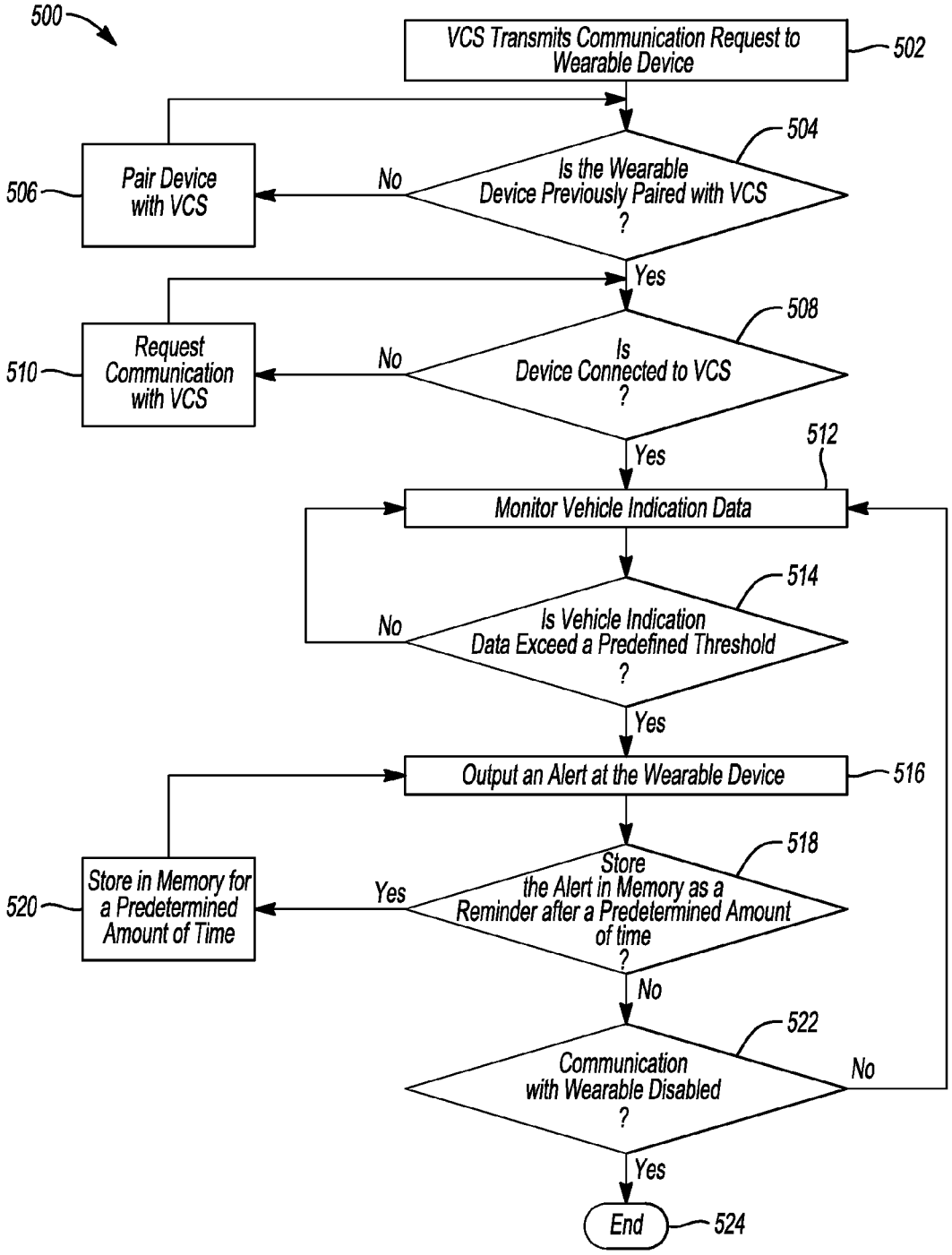
FIG. 6 is a flow chart illustrating an example method of the wearable device receiving vehicle indication messages from the vehicle computing system according to an embodiment.

FIG. 6 is a flow chart illustrating an example method 500 of the wearable device receiving vehicle indication messages from the VCS 1 according to an embodiment. The method 500 may be implemented using software code contained within the nomadic device, wearable device, VCS, and a combination thereof. The vehicle and its components illustrated in FIGS. 1-5 are referenced throughout the discussion of the method 500 to facilitate understanding of various aspects of the present disclosure. The method 500 of outputting vehicle indication data at a wearable device via a communication link with the VCS may be implemented through a computer algorithm, machine executable code, or software instructions programmed into a suitable programmable logic device(s) of the vehicle, such as the vehicle control module, the nomadic device control module, smartwatch control module, another controller in communication with the vehicle computing system, or a combination thereof. Although the various operations shown in the flowchart diagram 500 appear to occur in a chronological sequence, at least some of the operations may occur in a different order, and some operations may be performed concurrently or not at all.

In operation 502, the VCS may transmit a communication request to the wearable device. For example, the VCS may transmit a communication request with the wearable device via a nomadic device connection. The VCS may determine if a wireless connection has been previously paired with the wearable device and/or nomadic device in operation 504. If the wearable device/nomadic device have not been paired with the VCS, the VCS may request pairing before enabling communication with the wearable device/nomadic device in operation 506.

In operation 508, if the nomadic device/wearable device is recognized as having been previously paired with the VCS, the device may establish a wireless connection with the VCS. If a wireless connection is not established with the nomadic device/wearable device, the VCS may transmit a request to wirelessly connect with the one or more devices in operation 510.

In operation 512, the VCS may monitor vehicle indication data that may include one or more parameters associated with vehicle systems and sensors. The VCS may compare the vehicle indication data to one or more predefined threshold values in operation 514.

For example, the VCS may enable a user to configure one or more parameters associated with a predefined threshold. For example, the VCS may output at a user interface a configuration screen to allow a user to select threshold values for one or more parameters. The VCS may allow a user to enter one or more threshold values for a fuel level so that the system may provide an alert when the fuel level reaches the threshold values. In one example, the user may specify the threshold value for the fuel level to be set to one-eighth of a tank, two gallons, fifty miles to empty, and/or a combination thereof.

In another example, the nomadic device may enable a user to configure one or more parameters to be associated with a predefined threshold value via an application. The nomadic device may configure the vibration and/or haptic feedback based on the one or more parameters associated with a predefined threshold. The nomadic device may compare the predefined threshold value to received data related to the one or more parameters from the VCS. The nomadic device may transmit vehicle indications or alerts to the wearable device if the received data exceeds the predefined threshold value(s). For example, in response to the parameter value being a fuel level, a user may configure, via a user interface at the nomadic device, one or more threshold values for the fuel level to set a signal to the wearable device to generate a vibration. The one or more threshold values associated with the fuel level may include a first threshold set to one-fourth of fuel and a second threshold set to one-eighth of fuel.

If a parameter from the vehicle indication data exceeds a predefined threshold, the VCS may output an alert to the wearable device in operation 516. For example, the wearable device generates a vibration in response to a wireless signal from the VCS. The wireless signal may contain the vibration pattern and/or haptic feedback to generate the alert at the wearable device. For example, the vibration pattern and/or haptic feedback may be based on at least one of amplitude, frequency, duration, period/duty-cycle and/or combination thereof of the wireless signal.

In response to an alert or other indication, the wearable device may vibrate via a vibrating motor to provide an indication to the vehicle operator. The VCS may store the alert in memory so that the system may transmit a reminder to the wearable device after a predetermined amount of time in operation 518. For example, the VCS may transmit a second low fuel alert after a predetermined amount of time has passed since the first low fuel alert was sent to the wearable device. In another example, the VCS may transmit one or more alerts based on a key-off (e.g., ignition off) detection.

In operation 520, the VCS may store in memory one or more alerts such that the system may transmit reminders to the wearable device. For example, the VCS may transmit one or more alerts after the predetermined amount of time in operation 516. In another example, the nomadic device may store the one or more alerts so that the nomadic device may transmit reminders to the wearable device after a predefined amount of time.

In operation 522, the VCS may monitor the communication with the wearable device/nomadic device. If the communication with the wearable device remains active or enabled, the VCS may continue to monitor the vehicle indication data in operation 512. The VCS may disable communication with the one or more applications at the nomadic device and/or wearable device based on a power down request via the ignition switch in operation 524.

While representative embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A system comprising:

a controller, in communication with a transceiver and a user interface, configured to:

in response to a vehicle indication exceeding a predefined threshold, generate a notification based on a predefined alert;

compare motion detection data received from a wearable device to a steering wheel angle to determine the wearable device belongs to a vehicle operator; and transmit, via the transceiver, the notification to the wearable device configured to output the predefined alert.

2. The system of claim 1, wherein the wearable device has a vibrating motor and is configured to control the vibrating motor based on the predefined alert.

3. The system of claim 1, wherein the notification is at least one of speed limitation, low fluid warning, fluid pressure warning, tire pressure low, out of lane detection and seat belt warning.

4. The system of claim 3, wherein the predefined alert is a number of vibrations for the at least one of speed limitation, low fluid warnings, fluid pressure warning, out of lane detection and seat belt warning.

5. The system of claim 1, wherein the predefined alert is at least one of a number of vibrations via a vibrating motor at the wearable device and an output message via a display at the wearable device.

6. The system of claim 1, wherein the predefined threshold is a fuel or fluid threshold value based on a user specified threshold value for tank fluid level, remaining amount of fuel value, or miles-per-gallon range.

7. The system of claim 1, wherein the controller is further configured to establish communication with the wearable device via a nomadic device in communication with the transceiver and the wearable device.

8. The system of claim 1, wherein the vehicle indication is monitored using vehicle sensors of at least one of radar, wheel speed, pressure, and fluid level sensors.

9. A vehicle computing system comprising:

a processor in communication with a transceiver and configured to:

receive motion detection data from a wearable device via a motion sensor;

compare the motion detection data to a steering wheel angle to determine the wearable device belongs to an operator of a vehicle; and transmit signals to the wearable device via the transceiver to generate a haptic alert based on a vehicle parameter monitored by vehicle sensors exceeding a threshold, the vehicle parameter associated with a predefined vibration pattern for the haptic alert based on at least one of an accelerator pedal, a radio volume, navigation information, and lane departure detection inputs or signals.

10. The vehicle computing system of claim 9, wherein the wearable device comprises a vibrating motor configured to adjust the predefined vibration pattern based on the haptic alert.

11. The vehicle computing system of claim 9, wherein the haptic alert is at least one of speed limitation, low fluid warning, fluid pressure warning, out of lane detection, volume control, turn-by-turn navigation data, and seat belt.

12. The vehicle computing system of claim 11, wherein the speed limitation is configured to have multiple values such as the threshold is a first predefined threshold speed and a second predefined threshold speed.

13. The vehicle computing system of claim 12, wherein the haptic alert is the predefined vibration pattern of a vibrating motor at the wearable device based on the first predefined threshold speed and the second predefined threshold speed.

14. The vehicle computing system of claim 11, wherein the haptic alert for the out of lane detection exceeding the threshold being set to monitor whether a turn signal is enabled when the vehicle is changing lanes, the out of lane detection is associated with the predefined vibration pattern equal to a continuous vibration at the wearable device until the out of lane detection falls below the threshold based on at least one of the vehicle remaining in a lane via the lane departure detection inputs or signals or enabling the turn signal.

15. The vehicle computing system of claim 9, wherein the predefined vibration pattern is based on at least one of amplitude, frequency, duration, and period/duty-cycle of the signal.

* * * * *